United States Patent [19]

Schreier

[11] 4,142,486

[45] Mar. 6, 1979

[54] FUEL-OIL MIXING APPARATUS FOR INTERNAL-COMBUSTION ENGINES

[76] Inventor: Joseph S. Schreier, S. 2718 Bates, Spokane, Wash. 99206

[21] Appl. No.: 830,440

[22] Filed: Sep. 6, 1977

[51] Int. Cl.[2] ..... F01M 3/00

[52] U.S. Cl. ..... 123/73 AD; 123/196 R; 184/6.28; 417/418

[58] Field of Search ..... 123/73 AD, 127, 196 R, 123/196 CP; 417/418; 184/6.28, 6.8

[56] References Cited

U.S. PATENT DOCUMENTS

| | | | |
|---|---|---|---|
| 2,721,453 | 10/1955 | Reutter | 417/418 |
| 3,653,784 | 4/1972 | Leitermann et al. | 123/73 AD |
| 3,707,955 | 1/1973 | Ulbing | 123/73 AD |
| 3,762,380 | 10/1973 | Schultz | 123/73 AD |
| 3,784,334 | 1/1974 | Hilgert | 417/418 X |
| 3,886,914 | 6/1975 | Ahrns et al. | 123/73 AD |
| 3,913,551 | 10/1975 | Shaver | 123/73 AD |
| 3,929,110 | 12/1975 | Raikov et al. | 123/73 AD |

FOREIGN PATENT DOCUMENTS

| | | | |
|---|---|---|---|
| 1214043 | 4/1966 | Fed. Rep. of Germany | 123/196 CP |
| 576873 | 5/1958 | Italy | 123/73 AD |

*Primary Examiner*—Ira S. Lazarus

*Attorney, Agent, or Firm*—Wells, St. John & Roberts

[57] ABSTRACT

A mixing apparatus for fuel and oil to be supplied on demand to an internal-combustion engine. An oil reservoir separate from a fuel tank is provided with an expandable chamber assembly and a positive displacement pump which are jointly operated in an opposed tandem relationship. The chamber assembly is used to supply mixed fuel and oil on demand to the engine fuel intake. The positive displacement pump draws measured amounts of oil from the reservoir during each stroke cycle and injects this measured amount into the incoming fuel in the chamber assembly. As one moves through its suction stroke, the other moves through its delivery stroke. The ratio between the volume displacement of the pump relative to the volume displacement of the expandable chamber assembly is equal to the desired volume ratio of oil to fuel at the engine fuel intake. The oil and fuel are thoroughly mixed as they are delivered from the apparatus.

14 Claims, 6 Drawing Figures

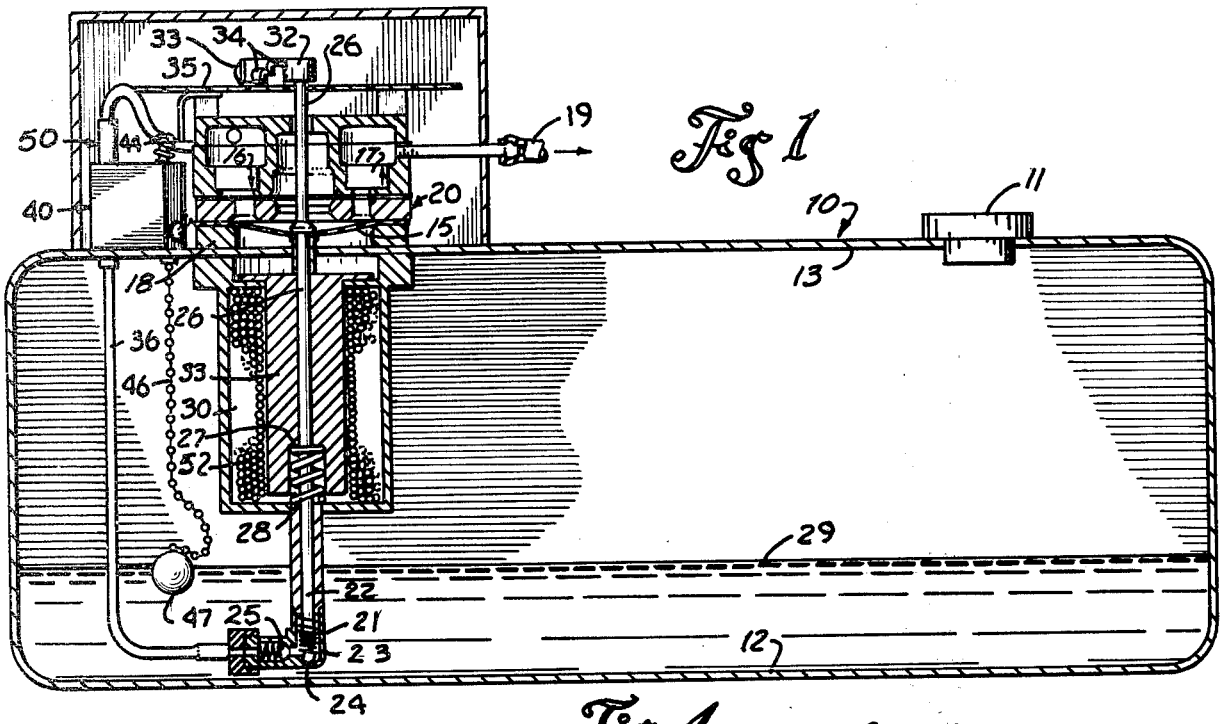
Fig 1
33
34
32
26
35
50
44
19
40
20
15
10
11
13
18
26
36
46
33
30
27
52
28
29
22
47
25
21
23
12
24
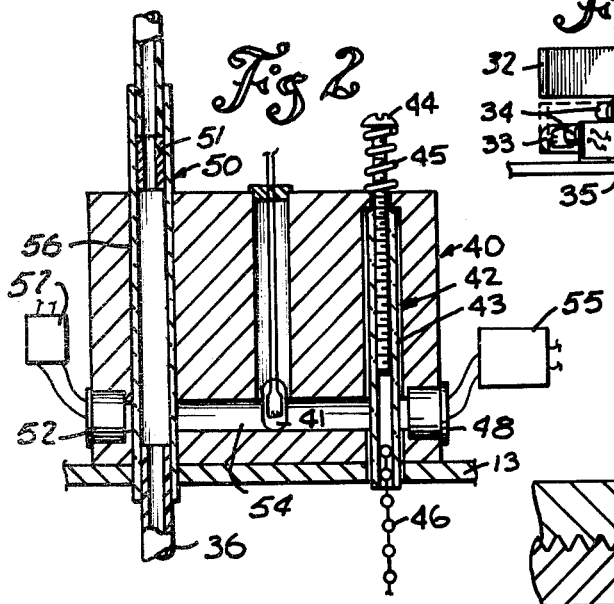
Fig 2
51
50
44
45
56
40
57
42
43
55
52
41
48
13
54
46
36
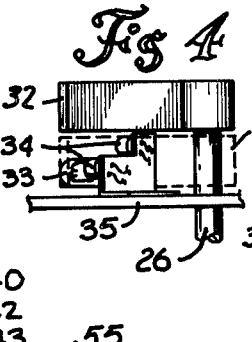
Fig 4
32
32a
34
33
35
26
Fig 5
32
33
34
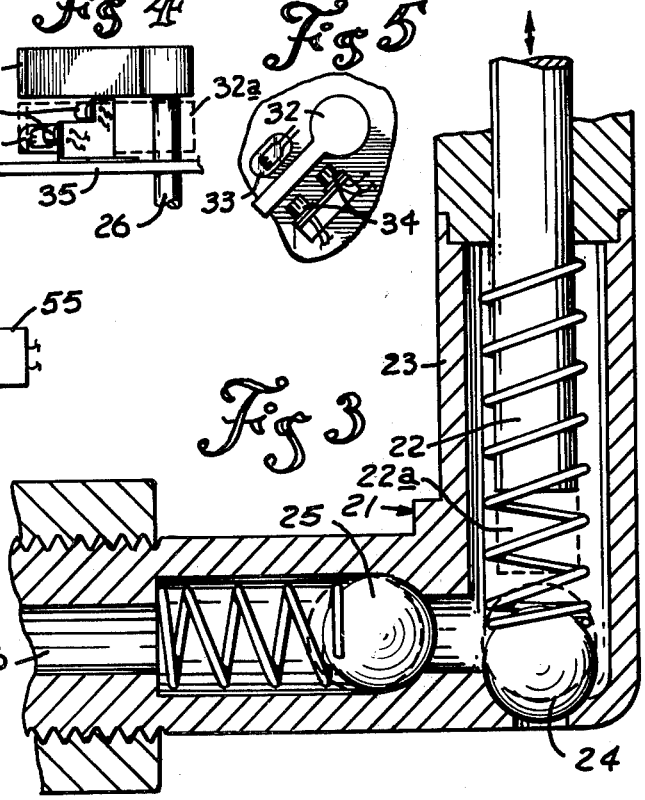
Fig 3
23
22
22a
21
25
36
24
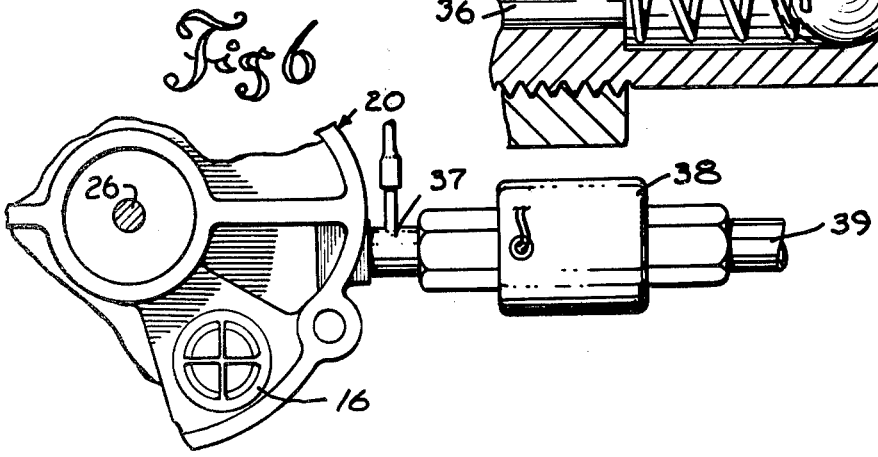
Fig 6
20
26
37
38
39
16

FUEL-OIL MIXING APPARATUS FOR INTERNAL-COMBUSTION ENGINES

BACKGROUND OF THE INVENTION

Many small internal-combustion engines, particularly two-cycle engines, are designed to operate on a gasoline and oil mixture for lubrication purposes. Such engines are widely used in marine applications and specifically in outboard drive units for propelling boats.

It is conventional to premix the fuel and oil for such engines. A typical volume ratio of gasoline to lubricating oil is 50:1. Such premixing involves several difficulties, particularly in conjunction with the English measurements used today in the United States. Gasoline is sold and measured in gallons, while lubricating oil is sold and measured in quarts, pints, cups and ounces. There is substantial room for mathematical error in making the necessary calculations to properly mix the two materials in a ratio such as 50:1. Furthermore, the gasoline and lubricating oil is typically mixed within a portable fuel tank. For proper mixing, the gasoline should be added to the lubricating oil. Consistent mixing or agitation is difficult to attain. If allowed to settle, there is a problem of resulting stratification of the two substances within the tank. These same problems exist on a larger scale where gasoline and lubricating oil are premixed by a vendor in larger stationary tanks and then pumped to the portable tanks of the ultimate users.

The present apparatus provides an electro-mechanical device for injecting measured amounts of lubricating oil into the fuel supply line connected to an engine. It mixes the oil on a demand basis so that only oil needed for proper lubrication of the fuel being immediately supplied to the engine is handled at any given period of time. It assures consistent mixing of the fuel and oil by handling both in small charges in a repetitive fashion. A self-contained device is provided separate from the engine and the normal fuel tank used with the engine. It requires no modification of engine operation and assures proper consistent lubrication during engine operation.

OBJECTS OF THE INVENTION

The first object of the invention is to provide a practical mixing apparatus for combining lubricating oil and gasoline being supplied to an internal combustion engine which operates on a gasoline-lubricating oil mixture.

Another object is to provide a means for accurately and consistently injecting lubricating oil into a gasoline fuel line to meet the operational requirements of an internal combustion engine.

Another object of this invention is to provide such an apparatus which can be safely used in marine applications, where there is a constant danger of fire by ignition of gasoline vapors.

Another object of this invention is to provide such an apparatus with automatic features to monitor the operation of the lubricating oil mixing system.

These and further objects will be evident from the following disclosure and the accompanying drawings, which illustrate a preferred embodiment of the invention.

DESCRIPTION OF THE DRAWINGS

FIG. 1 is a vertical sectional view through the device;

FIG. 2 is a vertical sectional view through the monitor block;

FIG. 3 is an enlarged fragmentary sectional view of the oil pump;

FIG. 4 is an enlarged elevation view of the upper end of the actuator rod, showing the solenoid controls;

FIG. 5 is a plan view of the apparatus shown in FIG. 4; and

FIG. 6 is a fragmentary plan view of the intake portion of the expandable chamber assembly.

DESCRIPTION OF A PREFERRED EMBODIMENT

The device shown in the drawings is designed to combine and deliver lubricating oil and gasoline to an internal combustion engine (not shown) that requires a fuel-oil mixture at the engine fuel intake. The engine fuel intake will normally be the fuel supply connection to the engine fuel pump, this connection being conventionally in communication with a portable or permanent fuel tank containing a premixed supply of fuel and oil. Since no modification is required of either the engine or the fuel tank, these conventional assemblies are not illustrated. The device is particularly adapted for marine use on boats powered by an outboard motor including a two-cycle engine supplied with fuel from tanks located within the boat. It accurately mixes the fuel and oil on demand, as required by engine operation. It is designed to operate safely in a marine environment, which constantly poses a substantial fire hazard due to the presence of gasoline vapors.

As can be seen in FIG. 1, an enclosed oil reservoir 10 is provided in the form of a tank having a bottom wall 12, a top wall 13, and a filler cap 11 removably secured through an aperture in the wall 13. Oil is maintained in the reservoir 10 during operation of the device, the illustrated oil level being shown at 29.

An expandable fuel-oil assembly 20 is mounted to the exterior of the wall 13. Chamber assembly 20 includes a flexible diaphragm 15 mounted within a chamber housing 18 for up-and-down reciprocal movement along a vertical axis. Chamber assembly 20 includes an inlet valve 16 and a delivery valve 17. Its inlet valve 16 is adapted to be connected to an external fuel supply, and constitutes a check valve permitting flow of fuel into the chamber housing 18 but prohibiting reverse flow. The delivery valve 17 is adapted to be connected to an engine fuel intake, and is also a check valve. It permits discharge of fluid from within the chamber housing 18, but prohibits return of the fluid to the housing 18. Assembly 20 includes necessary seals, gaskets and other details for proper utilization of the diaphragm expandable chamber assembly as a completely enclosed working unit.

An oil pump 21 is located within the oil reservoir 10 adjacent its bottom wall 12. It comprises a cylindrical piston 22 movable within a pump housing 23 along a vertical axis which is coaxial with the central vertical axis through the chamber assembly 20. The pump 21 also includes an inlet valve 24. Both are illustrated as conventional ball check valves, having spherical ball elements which are spring biased toward valve seats. The inlet valve 24 is in open fluid communication with the interior of the oil reservoir at an elevation below the normal operating level of the oil. The delivery valve 25 is operatively connected to the inlet valve 16 of the chamber assembly 20 by an oil conduit 36. Oil from the pump 21 is injected into the incoming fuel by means of a tee 37 (FIG. 6) leading directly to the chamber assembly inlet valve 16.

The chamber assembly and pump are operated in unison in an opposed tandem relationship. The displacement members — diaphragm 15 and piston 22 — move simultaneously. One displacement member is moved through its suction stroke during movement of the other through its delivery stroke.

This simultaneous movement of the displacement members is accomplished through their common connection to an actuator rod 26, which is coaxially aligned with the displacement members 15, 22. The actuator rod 26 extends upwardly from a shoulder 27, which is yieldably urged in an upward direction by a compression spring 28. The lower end of the actuator rod 26 is fixed to the previously described piston 22 of the pump 21. The intermediate portion of rod 26 is operatively connected to the diaphragm 15 by radially protruding collars and shoulders. Its upper end has a radial flag 32 protruding to one side above chamber assembly 20.

The lower portion of the rod 26 is surrounded by an electric solenoid 30 mounted to reservoir 10 and comprising the usual electromagnet 52 and coaxial core 53. The core 53 is fixedly secured to the actuator rod 26. Rod 26 is therefore reciprocated in unison with the solenoid core 53.

The upper end of actuator rod 23 is received through a circuit board 35 on which the elctronic controls (not shown) for this device can be mounted. While other types of electric controls can be used, it is preferred that the device be controlled by solid state electronic components and light responsive sensors to thereby eliminate any danger of a spark that might ignite gasoline vapors.

The solenoid 30 is controlled by a pair of light receivers 34 mounted to the upper surface of the circuit board 35. The light receivers 34 face a light source or lamp 33, also fixed to the upper surface of the circuit board 35. As can be seen in FIGS. 4 and 5, the flag 32 at the upper end of actuator rod 26 is interposed between the light source 33 and the receivers 34. The two light receivers 34 are at different elevations parallel to the axis of rod 26. They monitor the axial position of rod 26 to control operation of solenoid 30 as will be described below.

An electrically operated valve 38 is interposed in the fuel supply line 39 leading to the tee 37 and inlet valve 16 (FIG. 6). The valve 38 is normally closed, but is in an open condition when electric power is supplied to it from a suitable source (not shown), such as a direct current battery conventionally used for starting a marine engine.

A flow-level monitor block assembly 40 is provided adjacent to the chamber assembly 20 on the upper surface of the top wall 13. It encloses a central light source or lamp 41 located within a horizontal light chamber 54. One end of the light chamber 54 mounts an oil level monitor 42. Its remaining end mounts an oil flow monitor 50.

The oil level monitor comprises a transparent tube 43 slidably mounted within a vertical bore that intersects the light chamber 54. The upper end of tube 43 is adjustably fixed to a screw 44 which protrudes above the monitor block assembly 40 and is lightly biased by a surrounding compression spring 45. The lower end of tube 43 is fixed to a flexible chain 46 that suspends a float 47 within the oil reservoir 10. The weight of float 47 and the length of chain 46 is such that the tube 43 will be pulled downwardly in opposition to spring 45 when the oil level 29 reaches a predetermined low level. This will cause the opaque screw 44 to partially block passage of light to a light receiver 48. The resulting electronic signal can be utilized to operate a signaling device 55, which might be a lamp, bell, or any type of electrical or electromechanical device to warn the user of the low oil level condition.

The oil flow monitor 50 comprises a transparent tube 56 fixed within a vertical bore through the monitor block assembly 40 and intersecting the light chamber 54. The transparent tube 56 is joined to opposed intermediate ends of the oil conduit 36. An opaque flow indicating slug 51, in the form of a small cylindrical tube, is slidably received within the transparent tube 56 for vertical movement. The geometry of slug 51 is such that normal operation of the mixing device will maintain the slug 51 in its upper position abutting the upper length of the oil conduit 36 as shown in FIG. 2. However, should the flow of oil through the transparent tube 56 terminate for a predetermined period of time, the slug 51 will settle downward and eventually partially block the transmission of light from the light source 41 to a light receiver 52.

The light receiver 52 is operatively connected to a second signaling device 57 to provide a visual or audible signal to the user. It is also operatively connected to valve 38 so as to open the electric circuit to valve 38 in response to lack of oil flow from the second pump 21 to the first pump 20 during a predetermined period of time. The design of the oil flow monitor 50 must be such as to assure that slug 51 will remain above the elevation of the light chamber 54 within the monitor block assembly 40 during low speed or idling operation of the engine. It is also necessary to design the electrical or electronic controls for the apparatus to permit the user to override the light receiver 52 for a short duration of time during cranking of the engine to permit startup. This can be accomplished by conventional time delay circuitry.

The operation of the mixing device is automatically determined in response to the fuel demand of the engine. The expandable chamber assembly 20, which supplies the mixed fuel and oil to the engine through a fuel delivery line 19 connected to its delivery valve 17 basically comprises a spring biased diaphragm which moves upwardly through its delivery stroke in response to the fuel demand through delivery valve 17. However, as diaphragm 15 is moved upwardly by spring 28 and actuator rod 26, the piston 22 is also moved upwardly through its suction stroke. Therefore, as the mixed fuel and oil is being discharged from the expandable chamber assembly 20, a measured charge of oil is being received within pump housing 23. The volume of each charge of oil received within the pump housing 23 is equal to the pump displacement of the pump 21. Similarly, the total volume of the mixed fuel and oil being delivered to the engine at the same time is equal to the chamber displacement of the chamber assembly 20. To assure accurate mixing of the oil and fuel in the required ratio determined by the engine requirements, one must design the assemblies so that the ratio between the volume displacement of pump 21 to the volume displacement of the diaphragm chamber assembly 20 is equal to the desired volume ratio of oil to fuel required at the delivery valve 17. As an example, if the engine requires a 50:1 fuel-oil mixture, the displacement of piston 22 should be 1/50th the displacement of the diaphragm chamber assembly 20. This will assure accurate mixing of the fuel and oil in a ratio within the industry-accepted limits of ±10%.

When the actuator rod 26 has moved axially upward to complete the delivery stroke of chamber assembly 20 and the suction stroke of pump 21, its limit of movement will be detected by the upper light receiver 34, which will receive light from the light source 33. This electronic signal is relayed to the solenoid 30 through conventional control circuitry to thereby actuate solenoid 30 and move the rod 26 in an axially downward direction. During such movement, the diaphragm 15 will be moved through its suction stroke and the piston 22 will simultaneously be moved through its delivery stroke. A measured charge of oil (having a volume illustrated by dashed lines 22*a* in FIG. 3) will be ejected from the pump 21 through its delivery valve 25 and conduit 36 to the tee 37.

The measured amount of oil is injected into the incoming fuel received from line 39 at a location downstream from valve 38. The mixed oil and fuel will therefore flow through inlet valve 16 into the interior of chamber assembly 20. The measured oil is positively injected into the fuel line by pressure from the pump 21 and is assisted by the negative pressure within the assembly 20 as the diaphragm 15 moves through its suction stroke. This conjoint operation of assemblies 20, 21 assures delivery of the oil and immediate mixing of the oil and incoming fuel. The action of solenoid 30 is very rapid and of short duration. As this process is repeated in response to the engine demand for fuel, the turbulence within the various lines and within the housing 18 assures intimate, continuous and consistent mixing of the oil and fuel.

When the actuator rod 26 reaches its lower limit of movement due to operation of solenoid 30, the lower light receiver 34 on circuit board 35 will be activated by the resulting movement of flag 32 to the position shown at 32*a* in FIG. 4. The lower light receiver 34 then de-energized the solenoid 30, permitting actuator rod 26 to again move upwardly in response to the biasing force applied to it by spring 28 and the hydraulic pressure within the housing 18 resulting from engine demand for fuel.

The controls illustrated on the device are designed for fail-safe operation. Should electric power to the device be terminated, valve 38 will automatically close and light receivers 34 will be rendered inoperative. This will shut down the flow of fuel to assembly 20 and to the engine and will terminate engine operation. Valve 38 also acts as an antisiphon valve, preventing flow of oil to the gasoline fuel tank. At the same time, operation of unit assemblies 20, 21 will also terminate until such power is restored. The previously described oil level monitor 42 provides a signal to the operator warning him of this condition so that additional oil can be provided to the oil reservoir 10 to continue operation of the device. However, should deliver of oil be terminated for any reason, this will be detected by the oil flow monitor 50, which is operatively connected to the valve 38 to again terminate delivery of fuel through the chamber assembly 20 and to the engine. It is preferable that the electronic controls include means to manually override the oil flow monitor 50, at least for a short duration of time, to permit the user to operate the engine so as to avoid an emergency situation. However, the automatic termination of engine operation when oil is not being delivered to the fuel line is desirable to prevent resulting engine damage. Since the most common reason for termination of oil flow will be lack of oil within the oil reservoir 10, the user can remedy the problem by again adding oil through the filler cap 11.

Various modifications might be made with respect to the specific details of the device as illustrated. It is not intended that the structure be limited to the specific types of pumping devices shown in the drawings. While the combination of a diaphragm chamber assembly and a piston pump for the described purposes is both economical and effective, other suitable positive displacement pumps actuated in unison could be substituted in place of the elements shown.

Having described my invention, I claim:

1. A fuel-oil mixing apparatus for mixing and delivering oil and fuel to an internal combustion engine of the type requiring an oil-fuel mixture at its engine fuel intake, comprising:

an oil reservoir;

a fuel-oil expandable chamber assembly mounted to the oil reservoir and having an inlet valve, a delivery valve, and a displacement member movable alternately through a suction stroke and a delivery stroke, the inlet valve of said chamber assembly being adapted to be connected to an external fuel supply, the delivery valve of said chamber assembly being adapted to be connected to an engine fuel intake;

a positive displacement oil pump mounted to the oil reservoir and having an inlet valve, a delivery valve, and a displacement member movable alternately through a suction stroke and a delivery stroke, the inlet valve of said pump being in open fluid communication with the interior of the oil reservoir, the outlet valve of said pump being operatively connected to the inlet valve of said chamber assembly;

and common mechanical actuator means connected to the respective displacement members of said chamber assembly and pump for moving said displacement members in unison in an opposed tandem relationship, whereby one displacement member is moved through its suction stroke during movement to the other displacement member through its delivery stroke;

the ratio between the volume displacement of said pump relative to the volume displacement of said chamber assembly being equal to the desired volume ratio of oil to fuel at the delivery valve of said chamber assembly.

2. The fuel-oil mixing apparatus as set out in claim 1 wherein said actuator means comprises:

biasing means for moving the displacement member of said chamber assembly through its delivery stroke in response to external fluid demand at the delivery valve of said chamber assembly;

and electrical means for detecting completion of each delivery stroke of the displacement member of said chamber assembly and for subsequently moving it through its suction stroke in opposition to said biasing means.

3. The fuel-oil mixing apparatus as set out in claim 2 wherein said electrical means comprises a solenoid operably connected to said actuator means, said solenoid being adapted, when energized, to selectively move the displacement member of said chamber assembly through its suction stroke in opposition to said biasing means;

first control means operably connected to said solenoid and responsive to completion of a delivery stroke by the displacement member of said chamber assembly for energizing said solenoid;

and second control means operably connected to said solenoid and responsive to completion of a suction stroke by the displacement member of said chamber assembly for de-energizing said solenoid.

4. The fuel-oil mixing apparatus as set out in claim 1, further comprising:

a fuel supply valve connected in series with the inlet valve of said chamber assembly, said fuel supply valve being movable between open and closed positions;

and fluid flow monitoring means hydraulically interposed between the delivery valve of said pump and the inlet valve of said chamber assembly, said fluid flow monitoring means being operatively connected to said fuel supply valve for moving said fuel supply valve to its closed position in response to lack of oil flow from pump to said chamber assembly during a predetermined period of time.

5. A fuel-oil mixing apparatus as set out in claim 1, further comprising:

a normally-closed fuel supply valve in series with the inlet valve of said chamber assembly, said fuel supply valve being movable to an open condition when operably connected to a source of electrical energy.

6. The fuel-oil mixing apparatus as set out in claim 1, further comprising:

a normally-closed fuel supply valve in series with the inlet valve of said chamber assembly, said fuel supply valve being movable to an open condition when operably connected to a source of electrical energy;

and fluid flow monitoring means interposed between the delivery valve of said pump and the inlet valve of said chamber assembly and operatively connected to said fuel supply valve for terminating the connection of the fuel supply valve to a source of electrical energy in response to lack of oil flow from said pump to said chamber assembly during a predetermined period of time.

7. A fuel-oil mixing apparatus for mixing and delivering oil and fuel to an internal combustion engine of the type requiring an oil-fuel mixture at its engine fuel intake, comprising:

an oil reservoir in the form of an enclosed tank having a bottom wall;

a fuel-oil expandable chamber assembly, mounted to the oil reservoir and having an inlet valve, a delivery valve, and a displacement member movable alternately through a suction stroke and a delivery stroke, and inlet valve of said chamber assembly being adapted to be connected to an external fuel supply and the delivery valve of said chamber assembly being adapted to be connected to an engine intake;

a positive displacement oil pump mounted to the oil reservoir and having an inlet valve, a delivery valve, and a reciprocable piston displacement member movable alternately through a suction stroke and a delivery stroke along a piston axis, the inlet valve of said pump being located within the reservoir at an elevation adjacent the reservoir bottom wall of said pump being operatively connected to the inlet valve of said chamber assembly;

a coaxial actuator rod fixed to said piston displacement member of said pump and operatively connected to said displacement member of said chamber assembly, said actuator rod being adapted to move said displacement members in unison in an opposed tandem relationship, whereby one is moved through its suction stroke while the other is moved through its delivery stroke;

biasing means for moving the displacement member of said chamber assembly through its delivery stroke in response to fluid demand at its delivery valve;

selectively energized electrical solenoid means operably coupled to said actuator rod for moving the actuator rod along said piston axis to move the displacement member of the chamber assembly through its suction stroke while simultaneously moving the piston displacement member of said pump through its delivery stroke;

first control means operably connected to said solenoid means and responsive to completion of a delivery stroke by the displacement member of said chamber assembly for energizing said solenoid means;

and second control means operably connected to said solenoid means and responsive to completion of a suction stroke by the displacement member of said chamber assembly for de-energizing said solenoid means.

8. The fuel-oil mixing apparatus as set out in claim 7 wherein said solenoid means coaxially surrounds said actuator rod.

9. The fuel-oil mixing apparatus as set out in claim 7, further comprising:

a fuel supply valve connected in series with the inlet valve of said chamber assembly, said fuel supply valve being movable between open and closed positions;

and fluid flow monitoring means hydraulically interposed between the delivery valve of said pump and the inlet valve of said chamber assembly, said fluid flow monitoring means being operatively connected to said fuel supply valve for moving said fuel supply valve to its closed position in response to lack of oil flow from said pump to said chamber assembly during a predetermined period of time.

10. The fuel-oil mixing apparatus as set out in claim 7, further comprising:

a normally-closed fuel supply valve in series with the inlet valve of said chamber assembly, said fuel supply valve being movable to an open condition when operably connected to a source of electrical energy.

11. The fuel-oil mixing apparatus as set out in claim 7, further comprising:

a normally-closed fuel supply valve in series with the inlet valve of said chamber assembly, said fuel supply valve being movable to an open condition when operably connected to a source of electrical energy;

and fluid flow monitoring means interposed between the delivery valve of said pump and the inlet valve of said chamber assembly and operatively connected to said fuel supply valve for terminating the connection of the fuel supply valve to a source of electrical energy in response to lack of oil flow from said pump to said chamber assembly during a predetermined period of time.

12. The fuel-oil mixing apparatus as set out in claim 7, further comprising:

a normally-closed fuel supply valve in series with the inlet valve of said chamber assembly, said fuel supply valve being movable to an open condition when operably connected to a source of electrical energy;

fluid flow monitoring means interposed between the delivery valve of said pump and the inlet valve of said chamber assembly and operatively connected to said fuel supply valve for terminating the connection of the fuel supply valve to a source of electrical energy in response to lack of oil flow from said pump to said chamber assembly during a predetermined period of time; and wherein the operative connection of the delivery valve of said pump to the inlet valve of said chamber assembly being located upstream from said fuel supply valve.

13. The fuel-oil mixing apparatus as set out in claim 7, further comprising:

signal means;

fluid level monitoring means within said oil reservoir and operatively connected to said signal means for activating said signal means in response to detection of a predetermined minimum oil level within said reservoir, said predetermined minimum oil level being at an elevation within the reservoir above the elevation of the inlet valve of said pump.

14. The fuel-oil mixing apparatus as set out in claim 7 wherein the displacement member of the chamber assembly thereof comprises a resilient diaphragm arranged coaxially about said axial rod and operatively engaged thereby.

* * * * *